United States Patent [19]

Pomikacsek

[11] Patent Number: 5,067,283

[45] Date of Patent: Nov. 26, 1991

[54] METHOD AND DEVICE FOR THE TREATMENT OF THE UPPER SURFACES OF RAILS

[75] Inventor: Josef Pomikacsek, Altmunster, Austria

[73] Assignee: Firma, Linsinger Maschinenbau GmbH, Steyrermuhl, Austria

[21] Appl. No.: 611,793

[22] Filed: Nov. 13, 1990

[30] Foreign Application Priority Data

Nov. 14, 1989 [DE] Fed. Rep. of Germany ..... 3937812

[51] Int. Cl.[5] ..... E01B 31/17

[52] U.S. Cl. ..... 51/178; 51/262 A; 51/281 B; 104/279

[58] Field of Search ..... 51/178, 241 L G, 262 A, 51/262 R, 281 R; 104/280, 279

[56] References Cited

U.S. PATENT DOCUMENTS 3,850,691 11/1974 Bleil et al. ..... 51/178

4,178,724 12/1979 Bruno ..... 51/178

FOREIGN PATENT DOCUMENTS 2801110 8/1978 Fed. Rep. of Germany ..... 51/178

*Primary Examiner*—Roscoe V. Parker

*Attorney, Agent, or Firm*—Browdy and Neimark

[57] ABSTRACT

A method and a device for treating the upper surfaces of rails, where the upper surfaces of rails (3) are acted upon by movable grinding blocks (7) disposed on a bogie which can be moved along on the tracks and where a plurality of grinding blocks (7) is used. The grinding blocks (7) are periodically lifted and lowered again singly or in groups, cleaning of the work face of the grinding block (7) being performed during the lifting of the respective grinding block (7). In case of curves in the rails, a change of the position of the grinding block (7) in relation to a hydraulic unit (11), which vertically moves the grinding block (7), is detected by proximity switches (12), and the position of the hydraulic unit (11) can then be adjusted via a transverse guide (10).

20 Claims, 3 Drawing Sheets

METHOD AND DEVICE FOR THE TREATMENT OF THE UPPER SURFACES OF RAILS

BACKGROUND OF THE INVENTION

1. Field of the Invention

The present invention relates to a method and device for the treatment of the upper surfaces of rails.

2. The Prior Art

A comparable method or device in accordance with the species is already known from German Published, Non-examined Patent Application DE-OS 28 01 119 and from German Published, Non-examined Patent Application DE-OS 28 01 111. In both cases these are rail grinding machines where a plurality of rubbing blocks, disposed in the longitudinal direction of the rail oscillate back and forth. Thus the rubbing blocks are continuously in contact with the surface of the rail during the operation. Continuous action of the rubbing blocks on the surface of the rail is disadvantageous for the reason that the pores between the grinding particles gradually become plugged, which causes distinct deterioration of the grinding ability. Although the oscillating movement of the rubbing blocks in accordance with the state of the art causes a loosening of the grits and grinds being created on the treated surfaces, this self-cleaning effect is limited. The use of oscillating moving rubbing blocks requires a drive mechanism of the rail vehicle which is free of play in order to obtain perfect grinding effects. This entails additional costs.

BRIEF SUMMARY OF THE INVENTION

It is an object of the present invention to provide a method as well as a device for the treatment of the upper surfaces of rails which provide(s) a cost-effective, but highly efficient treatment of the upper rail surfaces with the aid of simple means.

This object is attained in the method according to the invention in that a. The rubbing blocks are periodically lowered into a work position individually or in groups during operation and subsequently lifted back into a position of rest, b. that at least one grinding block is in a work position during operation, and c. that the work face of each grinding block is cleaned while it is in the position of rest.

It is assured by means of the invention that it becomes possible to remove the unfavorably acting grits and grinds from the working faces of the grinding blocks. The grinding blocks are always returned to a clean condition during the operation of the device. This results in a considerable increase in the grinding effect of the grinding blocks and thus in increased treatment quality. Thus the method in accordance with the invention assures very high quality of treatment, together with considerably extended service life of the grinding blocks compared with known methods. Incidentally, it is not required that the drive mechanism of the rail vehicle be free of play. Practical embodiments of the method in accordance with the invention use spraying water and provide tracking of each grinding block which is independent of other blocks.

Cleaning is usefully performed by simple spraying with a water jet. The of cleaning the work faces of grinding blocks in general by simple spraying with a water jet assures, that in the course of the operation of the device the work faces of the grinding blocks are cleaned, but in a secondary effect the upper rail surfaces are also cleaned.

Increasing grinding effect with simultaneous effective cleaning is usefully achieved when the plurality (at least two) of the grinding blocks are in a work position. Simple activation or deactivation of the device is achieved in by lowering all grinding blocks by means of a common support. Lifting or lowering of individual grinding blocks takes place by means of separate drives. At the end of the treatment process the entire device is brought into a position of rest by the common support.

In a further embodiment of the method in accordance with the invention, the position of each grinding block transversely to the longitudinal direction of the rail is actively tracked. The invention compensates for sections of the rail with curves (switch areas etc.), in which a change of the position of the rail in respect to the tool holder, based on the wheel base of the bogies, occurs. Accordingly, it is possible to achieve an optimum surface quality of the treated rail even in curved sections of rails.

In this invention the grinding blocks are vertically movable individually or in groups whereby, that during operation a periodic lifting (position of rest) and lowering (working position) of the grinding blocks which alternates between the grinding blocks. A cleaning device is provided which cleans the work face of a grinding block which is in the position of rest. Continuous cleaning of the individual grinding blocks performed possible during operation which provides a considerable increase of the grinding effect of the grinding blocks and, accordingly, an increase in the quality of treatment of the rail surface is achieved.

Water jets are provided as cleaning devices in the area of the respective grinding blocks. Cleaning in general and cleaning by spraying water has the additional advantage that, besides the cleaning of the work faces of the grinding blocks, the surface of the rail is also cleaned as a secondary effect, so that the grinding blocks which are in the work position can treat a freshly cleaned rail surface.

Each grinding block or each grinding block unit is assigned its own retaining frame. Thus the control of the vertical movement of the grinding block can be performed in independently of the remaining grinding blocks. With separate retaining frames it is possible to achieve further movement of the retaining frame.

A hydraulic unit which is in contact with the central frame or the central support is used for driving the vertical movement of the grinding block, the retaining frame being used as a counter brace for the hydraulic unit. From the viewpoint of construction technology this embodiment is particularly easy to realize.

In a further embodiment of the device in accordance with the invention, the retaining frame and/or the hydraulic unit are connected with the support by means of a transverse guide. The retaining frame and/or the hydraulic unit of each grinding block can be moved vertically independently of the other grinding blocks. The grinding blocks, are arranged in the longitudinal direction of the rail, one behind the other, so that they correspond to the curvature of the rail.

The active tracking of the position of a grinding block transversely to the longitudinal direction of the rail is attained by: the drive causing the vertical movement, in particular the hydraulic unit, can be displaced transversely to the longitudinal axis of the rails by means of the transverse guide; the retaining frame is disposed on the hydraulic unit so that it can be moved transversely as well as vertically in respect to the rail; and proximity switches to detect a displacement of the retaining frame transversely to the rail are provided. This embodiment has the advantage that deviations from the desired position of the grinding tool can be detected based on the particular disposition of the retaining frame and that a correction of the transverse position can take place by means of the transverse guide. In this connection the retaining frame is usefully made U-shaped and has the tool holder on its open side. Both the retaining frame and the tool holder then enclose the hydraulic unit, thus forming a closed unit, and transverse mobility of the hydraulic unit is maintained.

In a further embodiment provides at least one flexible member between the retaining frame and the hydraulic unit. This flexible member brings about elastically stressed vertical mobility as well as transverse mobility of the embodiment frame.

A structurally particularly simple attainment provides for the insertion of at least one rubber bumper as the flexible member, which can be compressed and has a transversely acting flexibility.

A useful embodiment of the instant invention will be described below by means of the drawings.

Figure 1:
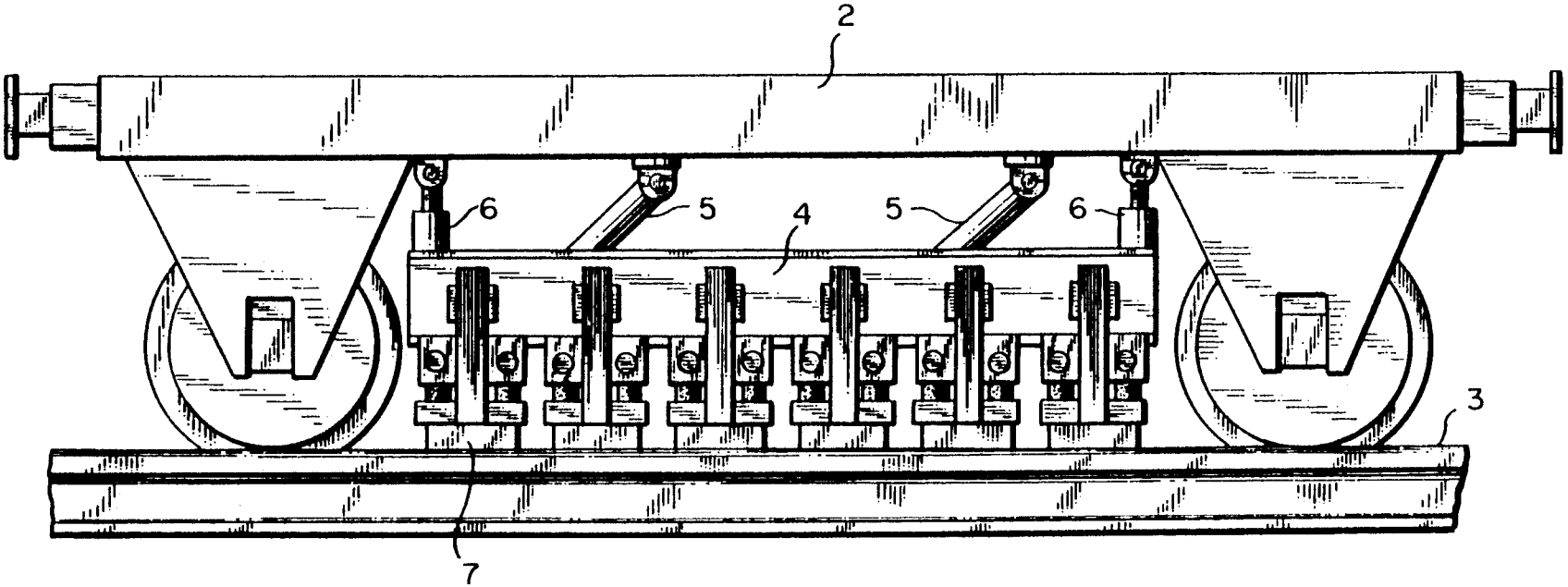
FIG. 1 is a schematic, greatly simplified illustration of the device for treatment of the upper surface of rails in accordance with the invention.

In FIG. 1 illustrates the device 1 in accordance with the invention for the treatment of the upper surface of rails 3. The device 1 comprises a bogie 2, which is self-propelled or moved by means of a traction engine (not shown). A treatment unit having a central support 4, which is provided vertically movable by means of hydraulic cylinders 6 and links 5, is disposed on each side of the bogie 2. The treatment unit may be lowered into the active position during operation by means of the common support 4. When the treatment process is ended, the entire treatment unit is lifted by means of the hydraulic cylinder 6.

The treatment unit comprises a plurality of grinding blocks 7 disposed one behind the other along the support 4 in the longitudinal direction of the rail 3, which act on the surface of the rail during operation. The underside of each grinding block 7 has a profile adapted to the contour of the surface of a rail.

Figure 2:
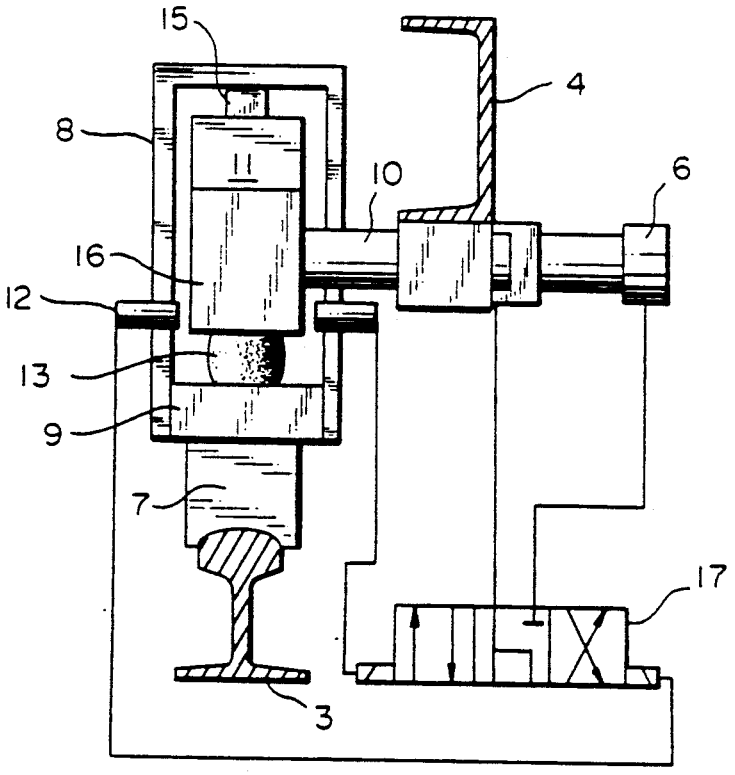
FIG. 2 illustrates the principle of the control or suspension of an individual grinding block from a point of view parallel to the longitudinal axis of the rail, where the grinding block is in the work position.

The structure of the seating or suspension of the individual grinding blocks 7 is illustrated in FIG. 2. The common support 4 is in contact with a hydraulic unit 11 via a transverse guide 10. The hydraulic unit 11 comprises a plunger 15 supported by a support element 16. The support element 16 and the plunger 15 form the hydraulic unit 11

Figure 3:
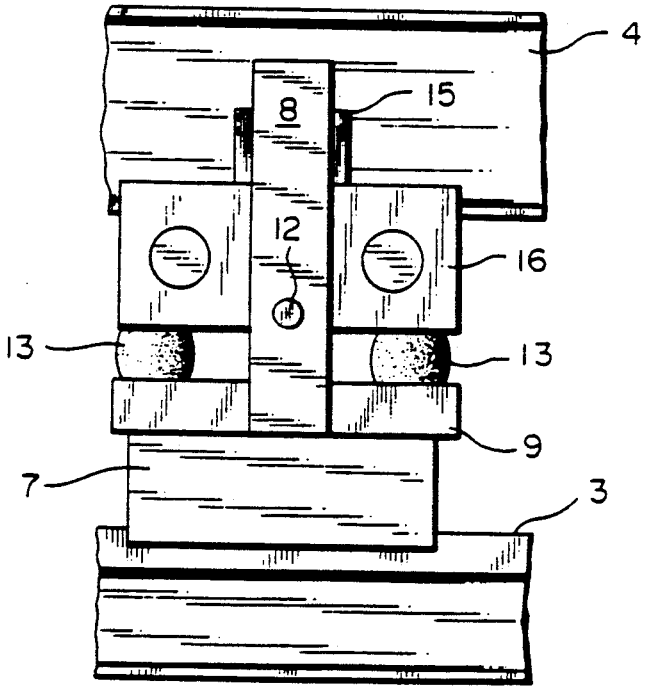
FIG. 3 shows the device in accordance with FIG. 2 from a point of view crosswise to the longitudinal axis of the rail.

The plunger 15 and the support element 16 are enclosed in a U-shaped retaining frame 8, the open end of which is closed by a tool holder 9, on which the grinding block 7 is disposed. The U-shaped retaining frame 8 as well as the tool holder 9 enclose the hydraulic unit 11, the plunger 15 of the hydraulic unit 11 acting on the inside of the narrow side of the U-shaped frame 8. Two rubber bumpers 13 have been inserted between the tool holder 9 and the underside of the support element 16 of the hydraulic unit 11, as illustrated in FIG. 3. When the plunger 15 of the hydraulic unit 11 is activated, the two rubber bumpers 13 permit a vertical movement of the retaining frame 8 in the direction of the hydraulic unit 11, the hydraulic unit 11 being supported on the tool holder 9 via the two rubber bumpers 13. This construction permits not only a vertical movement of the retaining frame 8 towards the hydraulic unit 11, but also horizontal shifting of the two parts in respect to each other. In connection with this, the two rubber bumpers 13 are being deformed in the direction of the deflection.

The hydraulic unit 11 is disposed displaceable transversely to the longitudinal axis of the rail by means of a hydraulic cylinder 6 via the transverse guide 10. Furthermore, proximity switches 12 are provided on the retaining frame 8 to determine changes of the distance of the hydraulic unit from the respective proximity switch 12. The proximity switches 12 are connected with a control acting on a hydraulic valve 17.

FIGS. 2 and 3 show the grinding block or its control in the working position, i.e. in direct contact with the upper surface of the rail.

Figure 4:
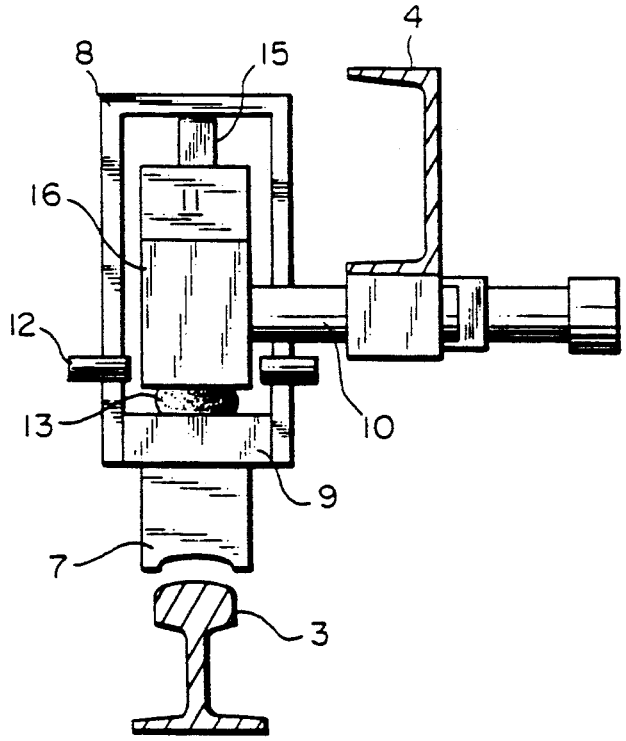
FIG. 4 shows the control or linking of the grinding block, the grinding block being in the raised position of rest.

In contrast thereto, FIG. 4 illustrates the position of rest of the grinding block 7, which can be attained by operation of the plunger 15. In this case the rubber bumpers 13 are correspondingly compressed.

Figure 5:
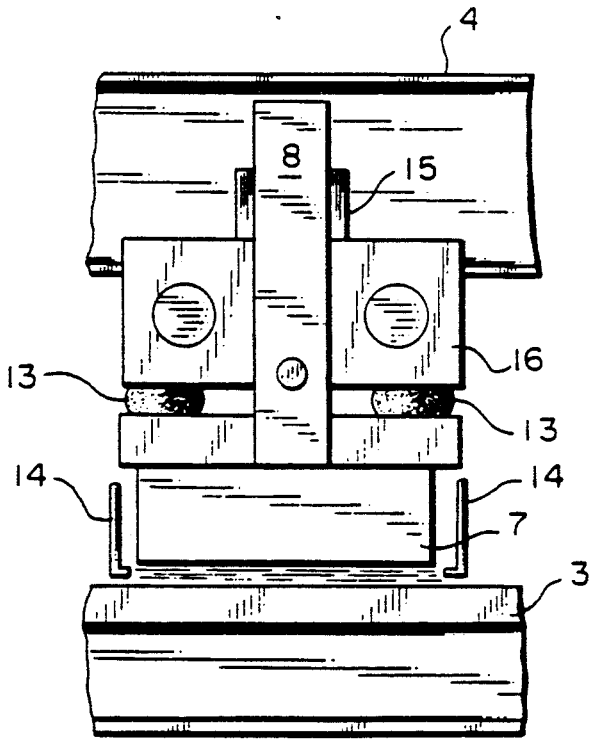
FIG. 5 shows the device in accordance with FIG. 4 from a point of view crosswise to the longitudinal axis of the rail.

As shown in FIG. 5, water jets 14 have been provided in the area of the grinding block 7 which, during the position of rest of the respective grinding block 7, free the work faces of the grinding block 7 and, in a secondary manner, also the rail surface from the adhering grits and grinds.

The mode of operation of the device according to the invention will be described in detail below. During operation (the support is lowered=activated position) of the device 1 the individual grinding blocks 7 are being alternately lifted or lowered by the operation of the respective plunger 15, the work faces of each of the lifted grinding blocks being cleaned by means of the water jet. The sequence of the grinding blocks regarding their working or resting positions can be set as desired, however, it has been shown to be advantageous to always maintain a plurality of grinding blocks in the working position.

Operation of the individual hydraulic units 11 or plungers 15 is performed periodically in sequence by means of a suitable control. The remaining grinding blocks 7 remain in the working position, the pressure exerted by the central support 4 being constant and actively acting on the grinding blocks which are in the working position. Because the frictional force is independent of the surface, constant operating force is assured.

It is possible to adjust the position of the grinding blocks in case of changes in the gauge or changes of the position of the bogie in relation to the tracks, for example in curves. Therefore, if the gauge or the position of the vehicle in respect to the tracks changes, this results in a change of the position of the retaining frame 8 in relation to the vehicle, based on the free transverse mobility of the retaining frame 8 holding the grinding block 7, which causes a deformation of the rubber bumpers 13. In other words, the position of the retaining frame 8 or of the tool holder 9 changes in respect to the hydraulic unit 11, which is in fixed contact with the support 4. The deviation in either direction from the respective desired position is sensed with the aid of proximity switches 12. The hydraulic valve 17 is operated with the aid of the signals from the proximity switches 12, by which the hydraulic cylinder 6 performs a compensating movement of the hydraulic unit 11 via the transverse guide 10. This compensating movement is performed until the respective proximity switch 12 cuts off when the grinding block 7 has reached the desired position.

The method in accordance with the invention and the device relating to it allow highly efficient treating of upper rail surfaces with an increased service life of the grinding blocks 7 in comparison to the state of the art. Furthermore, increased structural compactness of the grinding blocks, compared with the previously mentioned, known devices, is made possible. Finally, no special demands are being made on the drive mechanism of the traction vehicle. The invention is shown to be a considerable improvement in the field of surface treatment of rails.

The foregoing description of the specific embodiments will so fully reveal the general nature of the invention that others can, by applying current knowledge, readily modify and/or adapt for various applications such specific embodiments without departing from the generic concept, and therefore such adaptations and modifications are intended to be comprehended within the meaning and range of equivalents of he disclosed embodiments. It is to be understood that the phraseology or terminology herein is for the purpose of description and not of limitation.

What is claimed is:

1. A method for the treatment of the surfaces of rails, where the surfaces of the rails are acted upon by means of a plurality of movable grinding blocks disposed on a bogie which is moved along on the tracks, comprising the steps of:

a. periodically lowering at least one of said grinding blocks into a work position during operation and subsequently lifting said at least one of said grinding blocks into a position of rest, b. maintaining at least one grinding block in a work position during operation, and c. cleaning the work face of each grinding block while it is in the position of rest.

2. A method in accordance with claim 1, wherein said cleaning step is spraying on water.

3. A method in accordance with claim 1 wherein at least two grinding blocks are maintained in the working position.

4. A method in accordance with claim 1 wherein all grinding blocks are lowered by means of a common support and when in a lowered position the lifting and lowering of individual grinding blocks takes place by means of separate drives.

5. A method in accordance with claim 1 further comprising the step of tracking transversely to the longitudinal direction of the rail of each individual grinding block.

6. A method in accordance with claim 5, wherein the tracking of each grinding block takes place independently of the other grinding block tracking.

7. A device for the treatment of surfaces of rails, having a bogie having grinding blocks pressed on the surfaces of rails, having at least one support supported on the bogie which is in contact with grinding blocks and, having grinding blocks arranged one behind the other in the longitudinal direction of the rail, comprising:

grinding blocks (7) which are movable during operation to provide a periodic lifting (to position of rest) and lowering (to working position) of one or more of the grinding blocks (7) which periodic lifting and lowering alternates between the one or more grinding blocks, and a cleaning device for cleaning the work face of a grinding block (7) which is in the position of rest.

8. A device in accordance with claim 7, wherein said cleaning devices in the area of the respective grinding blocks (7) are water jets (14).

9. A device in accordance with claim 7 further comprising a retaining frame (8) for at least one of said grinding blocks (7).

10. A device in accordance with claim 7 further comprising a hydraulic drive for the movement of the grinding blocks (7) and the retaining frames (8) for counter bracing the hydraulic unit (11).

11. A device in accordance with claim 7 further comprising means for actively tracking the position transverse to the longitudinal direction of the rail (3) of each individual grinding block (7).

12. A device in accordance with claim 11, further comprising a retaining frame (8) connected with a central support by means of a transverse guide.

13. A device in accordance with claim 10, wherein the hydraulic unit (11), is be displaced transversely to the longitudinal axis of the rails (3) by means of a transverse guide (10), wherein the retaining frame (8) is disposed on the hydraulic unit (11) so that it can be moved transversely as well as in respect to the rail (3), and wherein proximity switches (12) detect a displacement of the retaining frame (8) transversely to the rail.

14. A device in accordance with claim 7 further comprising a U-shaped retaining frame (8) having an open side tool holder (9).

15. A device in accordance with claim 10, further comprising at least one flexible member provided between the retaining frame (8) and the hydraulic unit (11).

16. A device in accordance with claim 15, further comprising at least one rubber bumper (13) provided as a flexible member.

17. A device in accordance with claim 16, wherein said hydraulic unit (11) is supported on the tool holder (9) by a support element (16) and two rubber bumpers (13).

18. A device in accordance with claim 11, further comprising a hydraulic unit connected with a central support by means of a transverse guide.

19. A method for the treatment of the surfaces of rails, where the surfaces of rails are acted upon by means of a plurality of movable grinding blocks disposed on a bogie which is moved along on the tracks, comprising the steps of:

a. periodically lowering said grinding blocks individually or in groups into a work position during operation and subsequently lifting of said grinding blocks back into a position or rest, b. maintaining at least one grinding block in a work position during operation, and c. cleaning the work face of each grinding block while it is in the position of rest.

20. A device for the treatment of surfaces of rails, having a boogie having grinding blocks pressed on the surfaces or rails, having at least one support supported on the boogie which is in contact with grinding blocks and, having grinding blocks arranged one behind the other in the longitudinal direction of the rail, comprising:

grinding blocks (7) which are movable during operation to periodic lifting (to position of rest) and lowering (to working position) at least one of the grinding blocks (7) which periodic lifting and lowering alternates between at least one of the grinding blocks, and a cleaning device for cleaning the work face of a grinding block (7) which is in the position of rest.

* * * * *